US012060139B2

(12) United States Patent
May

(10) Patent No.: US 12,060,139 B2
(45) Date of Patent: Aug. 13, 2024

(54) MODULAR INFLATABLE PLATFORM SYSTEM

(71) Applicant: BOTE, LLC, Miramar Beach, FL (US)

(72) Inventor: Aaron May, Parker, CO (US)

(73) Assignee: BOTE, LLC, Miramar Beach, FL (US)

( * ) Notice: Subject to any disclaimer, the term of this patent is extended or adjusted under 35 U.S.C. 154(b) by 78 days.

(21) Appl. No.: 17/664,210

(22) Filed: May 19, 2022

(65) Prior Publication Data

US 2023/0192248 A1 Jun. 22, 2023

Related U.S. Application Data

(63) Continuation-in-part of application No. 17/661,726, filed on May 2, 2022, and a continuation-in-part of application No. 29/790,871, filed on Dec. 17, 2021.

(51) Int. Cl.

| | |
|---|---|
| ***B63B 34/52*** | (2020.01) |
| ***B63B 3/08*** | (2006.01) |
| ***B63B 7/08*** | (2020.01) |
| ***B63B 35/58*** | (2006.01) |

(52) U.S. Cl.
CPC ..... *B63B 35/58* (2013.01); *B63B 3/08* (2013.01); *B63B 7/085* (2013.01)

(58) Field of Classification Search
CPC ..... B63B 35/58; B63B 3/08; B63B 7/085; B63B 2029/043; B63B 34/26; B63B 34/52; B63B 32/51; B63B 32/70; A47C 4/54; A47C 1/146
USPC ..... 114/266
See application file for complete search history.

(56) References Cited

U.S. PATENT DOCUMENTS

| | | | | |
|---|---|---|---|---|
| 4,662,852 | A * | 5/1987 | Schneider | A47C 15/006 297/452.13 |
| 6,045,423 | A * | 4/2000 | Silvia | B63B 34/50 441/130 |
| 9,144,318 | B1 * | 9/2015 | Lagier | A47C 3/16 |
| 11,246,422 | B2 * | 2/2022 | de Grasse | A47C 1/143 |
| 11,325,684 | B2 * | 5/2022 | Bai | B63B 7/08 |
| 11,685,480 | B2 * | 6/2023 | Cooper | B63B 34/26 297/313 |
| 2021/0387700 | A1 * | 12/2021 | Bai | B63B 7/08 |
| 2022/0089256 | A1 * | 3/2022 | Cannon | B63B 32/40 |
| 2023/0278676 | A1 * | 9/2023 | Cooper | B63B 29/04 297/313 |
| 2023/0284783 | A1 * | 9/2023 | Mason | A47C 1/146 5/420 |
| 2023/0286619 | A1 * | 9/2023 | Blakeney | B63B 32/40 441/65 |

* cited by examiner

*Primary Examiner* — Nkeisha Smith
(74) *Attorney, Agent, or Firm* — Talus Law Group LLC

(57) ABSTRACT

The present invention is directed to an inflatable and floatable modular platform system wherein certain embodiments comprise an adjustable back-rest. The inflatable platform system of the present disclosure includes floating elements of differing shapes and sizes configured to be interconnected in order to allow users to stand, sit, and walk between floating elements. Embodiments include inflatable platforms having circular, arc-shaped, rectangular, and L-shaped inflatable platforms.

27 Claims, 9 Drawing Sheets

SECTION A-A
SCALE 1:10

MODULAR INFLATABLE PLATFORM SYSTEM

CROSS REFERENCE TO RELATED APPLICATIONS

This application claims the benefit of U.S. patent application Ser. No. 29/790,871 entitled INFLATABLE CHAIR filed on Dec. 17, 2021 and U.S. patent application Ser. No. 17/661,726 entitled MODULAR INFLATABLE PLATFORM SYSTEM filed on May 2, 2022, the entire contents of which are incorporated herein by reference in their entirety for all purposes.

FIELD OF THE INVENTION

The present invention is directed to an inflatable and floatable modular platform system. The inflatable platform system of the present disclosure includes floating elements of differing shapes and sizes configured to be interconnected in order to allow users to stand, sit, and walk between floating elements.

BACKGROUND OF THE INVENTION

Inflatable furniture and inflatable products, referred herein as inflatables, devised for outdoor recreation provide a buoyancy to keep users partially or entirely above the surface of the water on which they are deployed.

Traditional inflatables have been limited to spherical and cylindrical elements, including products such as rafts which relied upon adjoined cylindrical chambers which dictate the external form of the inflatable. Recent developments in technology, such as drop-stitch construction, enable the ability to manufacture inflatables in planar surfaces and other forms which do not rely upon cylindrically shaped chambers.

Inflatable furniture has traditionally been limited to individual units such as a raft, chair, or other unit, wherein the inflatable unit is used independently of other inflatable units. When multiple units are used in concert, maintaining proximity to other inflatable units to maintain a socially conducive distance is challenging. Thus, a need for a modular inflatable platform system of interconnectable inflatable units has been identified, wherein each unit is configured to be used as an individual unit, and can be alternatively used modularly when interconnected with other inflatable units to produce a configurable system.

SUMMARY OF THE INVENTION

It is an aspect of the present invention to provide a system of modularly interconnectable inflatable platforms wherein each inflatable platform is individually usable as a floating platform, or interconnectable with other inflatable platforms.

It is an aspect of certain embodiments of the present invention to provide a modular inflatable platform system comprising an inflatable platform wherein the inflatable platform comprises a recess for receiving a cooler, wherein the cooler is configured to keep beverages and other food items cool. The recess of the inflatable platform constrains the cooler therein to provide buoyancy and to prevent the tipping of the inflatable platform. Furthermore, placing the cooler within the recess allows the cooler to rest on a surface below the top surface of the inflatable platform resulting in a system having a lower center of gravity than a configuration of the cooler placed on the top surface of the inflatable platform.

It is an aspect of certain embodiments of the present invention to provide a modular inflatable platform system which comprises a first inflatable platform and a second inflatable platform, wherein the inflatable platforms are interconnectable to result in a system of inflatable platforms. The inflatable platforms each comprise at least one interconnection point located proximal to the perimeter of the inflatable platforms, or upon a top surface of the inflatable platform. In certain embodiments the inflatable platforms comprise interconnection points in the form of lashing points comprising a D-Ring, shackle, or other lashing points configured to receiving a tether therethrough for interconnection of the first inflatable platform and the second inflatable platform.

It is an aspect of certain embodiments of the present invention to provide at least one handle interconnected with a top surface of an inflatable platform. Alternate embodiments comprising handles interconnected with a side of an inflatable platform are within the spirit and scope of the present invention.

It is an aspect of certain embodiments of the present invention to provide inflatable platforms which are configured to be interconnected wherein the first inflatable platform and the second inflatable platform are constrained to prevent relative movement between the first inflatable platform and the second inflatable platform. In certain embodiments, the interconnection between the first inflatable platform and the second inflatable platform comprises at least one tensile element spanning between the first inflatable platform and the second inflatable platform. Certain embodiments employ at least two points of contact between a first inflatable platform and a second inflatable platform, wherein an external perimeter of a first inflatable platform is interconnected with an internal perimetral aspect of a second inflatable platform. As discussed herein, perimetral aspects such as a convex elements, and reflex angles are considered external perimetral aspects for the purposes of the present application. Furthermore, perimetral aspects such as concave elements, and internal angles are considered internal perimetral aspects for the purposes of the present application.

Certain embodiments of the present invention comprise a first inflatable platform comprising an external perimetral aspect, and a second inflatable platform comprising an internal perimetral aspect. The external perimetral aspect and the internal perimetral aspect are similarly shaped wherein the external perimetral aspect of the first inflatable platform is configured to be received by the internal perimetral aspect of the second inflatable platform, resulting in continuous contact between the first inflatable platform and the second inflatable platform.

It is an aspect of certain embodiments of the present invention to provide inflatable platforms which are configured to be interconnected wherein the first inflatable platform and the second inflatable platform are constrained to prevent relative movement between the first inflatable platform and the second inflatable platform. In certain embodiments the interconnection between the first inflatable platform and the second inflatable platform comprises two tensile elements spanning between the first inflatable platform and the second inflatable platform. For example, a first linear perimetral aspect of the first inflatable platform is abutted with a first linear perimetral aspect of the second inflatable platform, wherein each inflatable platform comprises a first lashing point and a second lashing point, wherein the lashing points of the inflatable platforms are configured to align with each other when the linear perimetral aspects of the inflatable platforms are abutted.

The interconnection of inflatable platforms resulting in the constraint of the inflatable platforms in relation to each other allows users to enjoy a modular inflatable platform system wherein users can lay, sit, or walk along and between the interconnected inflatable platforms. The interconnection of the inflatable platforms to each other results in a more stable inflatable platform system and allows for increased social interaction without the need for continual adjusting of inflatable platforms in relation to each other.

It is an aspect of certain embodiments of the present invention to secure and interconnect beverages and other personal items to the top surface of an inflatable platform using magnetic apparatus. Personal items include, but are not limited to: keys, cameras, pocket knives, or other items that have ferrous metal components that are desirably carried by outdoor sportspeople while engaged in fishing, paddling, boating, sailing, and other outdoor sports. Such technologies are disclosed by U.S. patent application Ser. No. 17/350,845 filed Jun. 17, 2021 to Cory Cooper ("the '845 application), and U.S. patent application Ser. No. 17/443,504 filed Jul. 27, 2021 to Cory Cooper ("the '504 application")—each of which are incorporated by reference in their entirety for all purposes herein.

Certain embodiments comprise an inflatable platform comprising an inflatable bolster or backrest which is configured to assist a user in laying or sitting upon the top surface of the inflatable platform. In certain embodiments a bolster comprises a circular cross section inflatable device interconnected with a top surface allowing a user to lean against or rest their head upon the bolster. In certain embodiments a back rest comprises an inflatable panel hingedly interconnected to a top surface of the inflatable platform, thus allowing a user to configure the back rest between 0-degrees and 180-degrees from the top surface of the inflatable platform.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Certain embodiments, as shown in FIG. 1A-FIG. 1E for example, of the present invention comprise an inflatable platform 1000. The inflatable platform 1000 comprises a top surface 1010, a bottom surface 1020, and a perimeter 1050 which defines the shape of the inflatable platform. The bottom surface 1020 of the inflatable platform is intended for direct contact with a body of water. The bottom surface 1020 of the inflatable platform of certain embodiments comprises a planar surface, however embodiments are not limited to having planar bottom surfaces, and alternate embodiments comprising non-planar bottom surface are within the spirit and scope of the present invention. The top surface of 1020 the inflatable platform comprises a planar form configured to allow users to lay, sit, walk, and otherwise interact with the top surface. Alternate embodiments comprising a non-planar top surface are within the spirit and scope of the present invention.

Certain embodiments of the present invention comprise a top surface 1010 and a bottom surface 1020 wherein the top surface 1010 and bottom surface 1020 are interconnected by a plurality of threads, typically polyester, wherein the plurality of threads maintain a thickness 1100 between the top surface 1010 and the bottom surface 1020. This interconnection between the top surface 1010 and the bottom surface 1002 is commonly referred to as drop-stitching. The volume contained between the top surface 1010 and the bottom surface 1020 comprises an air-tight chamber 1150 which is pressurized to inflate the chamber 1150. Alternate embodiments comprising alternate construction strategies known in the prior art are within the spirit and scope of the present invention.

Figure 1A:
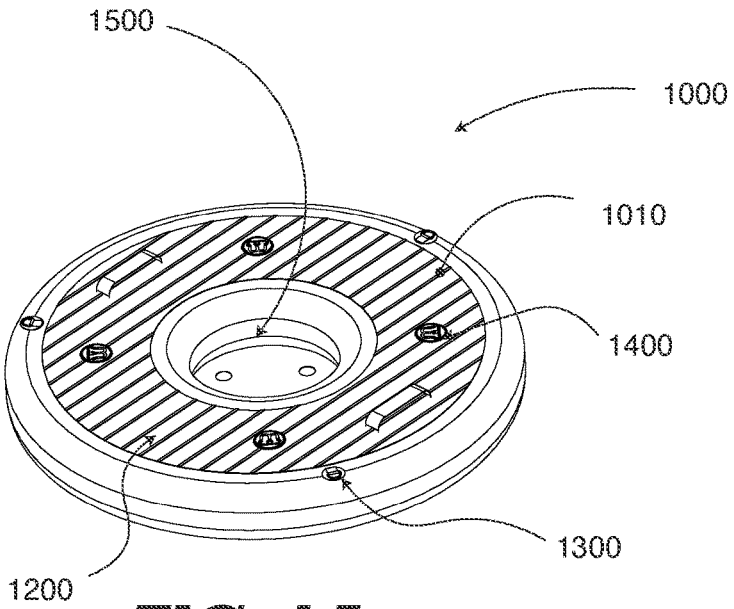
FIG. 1A—A perspective view of certain embodiments comprising an inflatable platform FIG. 1B—A top view of certain embodiments comprising an inflatable platform FIG. 1C—A side view of certain embodiments comprising an inflatable platform FIG. 1D—A cross-sectional view of certain embodiments comprising an inflatable platform as shown in FIG. 1B FIG. 1E—A bottom view of certain embodiments comprising an inflatable platform FIG. 2A—A top view of certain embodiments comprising a first inflatable platform configured to interconnect with a second inflatable platform FIG. 2B—A top view of certain embodiments comprising a plurality of inflatable platforms configured to interconnect with each other FIG. 3A—A top view of certain embodiments comprising an inflatable platform FIG. 3B—A side view of certain embodiments comprising an inflatable platform FIG. 3C—A perspective view of certain embodiments comprising an inflatable platform FIG. 4A—A top view of certain embodiments comprising an inflatable platform FIG. 4B—A side view of certain embodiments comprising an inflatable platform FIG. 4C—A perspective view of certain embodiments comprising an inflatable platform FIG. 5A—A top view of certain embodiments comprising a first inflatable platform configured to interconnect with a second inflatable platform FIG. 5B—A side view of certain embodiments comprising an inflatable platform FIG. 5C—A perspective view of certain embodiments comprising an inflatable platform FIG. 6A—A top view of certain embodiments comprising an inflatable platform FIG. 6B—A side view of certain embodiments comprising an inflatable platform FIG. 6C—A perspective view of certain embodiments comprising an inflatable platform FIG. 7A—A top view of certain embodiments comprising a first inflatable platform configured to interconnect with a second inflatable platform FIG. 7B—A top view of certain embodiments comprising a first inflatable platform configured to interconnect with a second inflatable platform FIG. 7C—A top view of certain embodiments comprising a first inflatable platform configured to interconnect with a second inflatable platform FIG. 8A—A top view of certain embodiments comprising a first inflatable platform configured to interconnect with a second inflatable platform FIG. 8B—A perspective view of certain embodiments comprising an inflatable platform FIG. 8C—A side view of certain embodiments comprising an inflatable platform FIG. 8D—A detail view of the inflatable platform shown in FIG. 8C
Figure 1B:
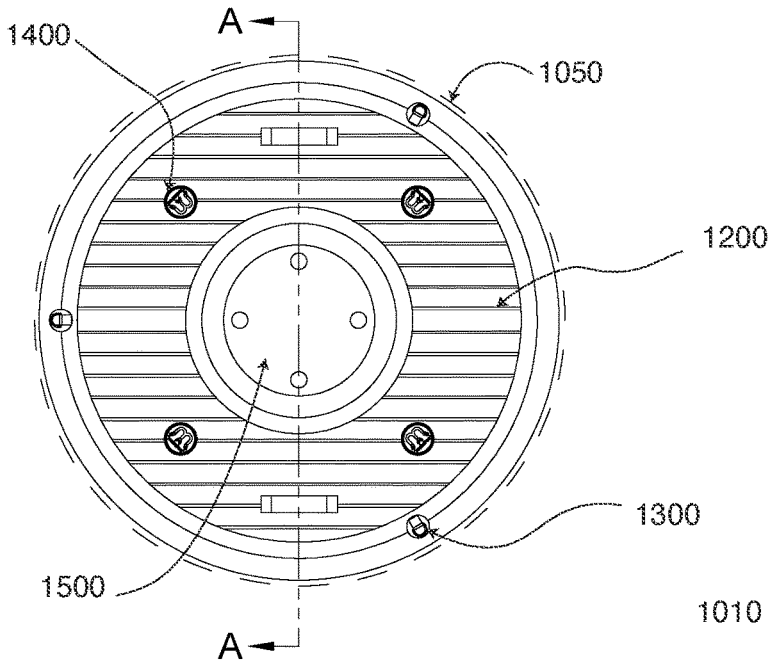
Figure 1C:
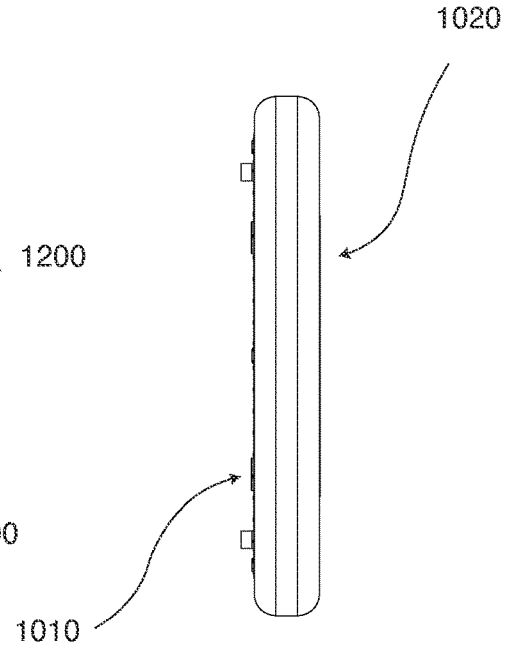
Figure 1D:
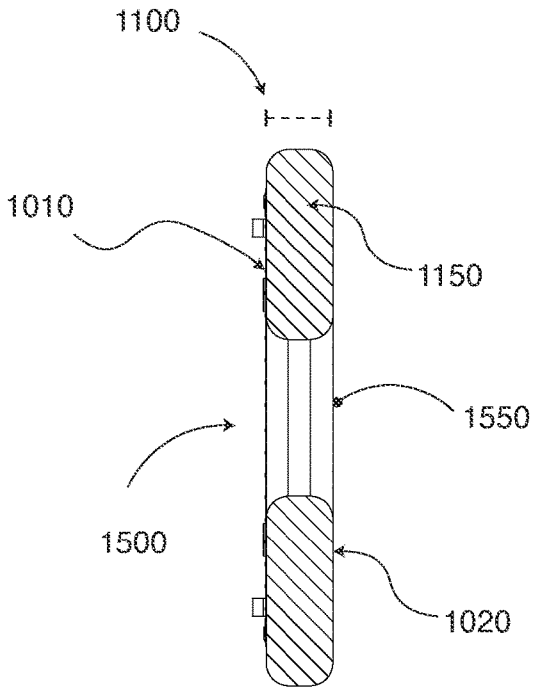
Figure 1E:
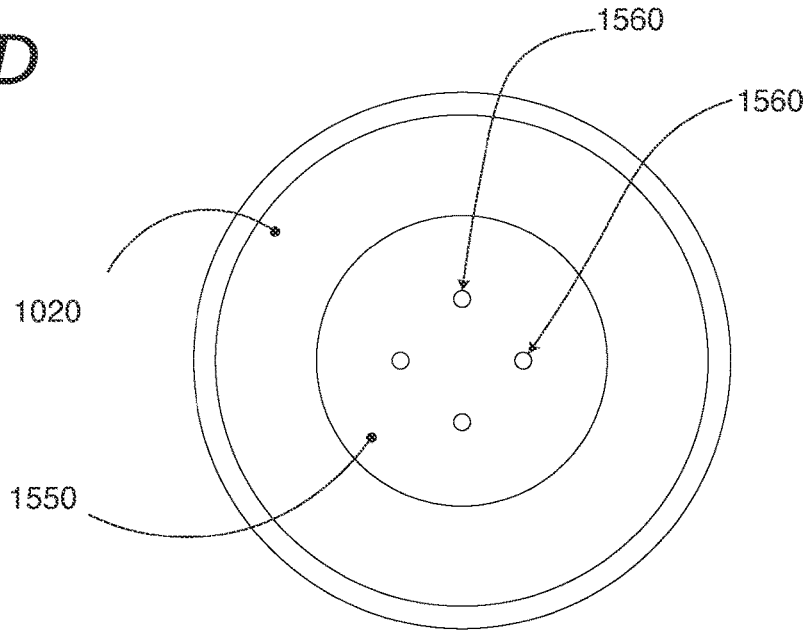

Certain embodiments of the present invention, as shown in FIG. 1A-FIG. 1B for example, comprise an inflatable platform wherein the top surface comprises grip enhancing surface treatment 1200. Grip enhancing surface treatments 1200 include, but are not limited to: texturized coatings, material bonded to the top surface of the inflatable platform, rubberized coatings, surface depth variation, or other methods of enhancing grip known in the existing state of the art.

Certain embodiments of the present invention, as shown in FIG. 1A-FIG. 1B for example, comprise an inflatable platform 1000 comprising at least one lashing point 1300 interconnected to a top surface 1010 of the inflatable platform. Alternate embodiments comprising a lashing point 1300 interconnected to the perimeter 1050 of the inflatable platform are within the spirit and scope of the present invention. The lashing point 1300 comprises an aperture wherethrough a tether, such as a rope or other flexible tensile load carrying device, can be passed to interconnect the inflatable platform to a structure or second inflatable platform. Alternate embodiments comprise a lashing point comprising devices commonly referred to as lashing pots, such as cloverleaf lashing pots which allow lashing with a device commonly referred to as an elephant's foot. Alternate embodiments comprising lashing points known in the state of the art are within the spirit and scope of the present invention.

Certain embodiments comprise an inflatable platform 1000 having a magnetic connection apparatus 1400 configured to receive and interconnect with drinkware and other objects as disclosed in the '845 application and the '504 application. An inflatable platform of such embodiments comprises at least one magnetic connection apparatus interconnected with the top surface 1010 of the inflatable platform. Certain embodiments comprise an inflatable platform comprising a plurality of magnetic connection apparatus 1300 distributed about the top surface 1010 of the inflatable platform.

Certain embodiments of the present invention comprise an inflatable platform 1000 having a top surface 1010, a bottom surface 1020, and an inflatable chamber 1150 therebetween having a thickness 1100. The inflatable platform 1000 further comprises a recess 1500 offset from a perimeter 1050 of the inflatable platform. The recess 1500 of certain embodiments (FIG. 1B) is located centrally in relation to the perimeter 1050 of the inflatable platform. The recess 1500 extends from the top surface 1010 to the bottom surface of the inflatable platform, wherein the bottom 1520 of the recess comprises a membrane 1550. The bottom of the recess 1500 of certain embodiments is coincident with the bottom surface 1020 of the inflatable platform wherein the depth of the recess is equal to the thickness 1100 of the inflatable platform. In alternate embodiments, the bottom 1020 of the recess is offset from the bottom surface 1020 of the inflatable platform wherein the depth of the recess is less than the thickness 1100 of the inflatable platform. Alternate embodiments wherein the recess 1500 comprises a thru-hole extending from the top surface 1010 of the inflatable platform to the bottom surface 1020 of the inflatable platform are within the spirit and scope of the present invention. In certain embodiments comprising a recess 1500, the bottom 1520 of the recess comprises at least one aperture 1560 wherein water captured in the recess is permitted to drain from the recess in a process commonly referred to as "self-bailing."

The recess 1500 of certain embodiments, as shown in FIG. 1B for example, comprises a circular form. Alternative embodiments comprise a recess 1500 having a polygonal form, or other shapes as desired, are within the spirit and scope of the present invention. In certain embodiments the recess is configured to receive a cooler, such as disclosed in U.S. Design Pat. No. D812,981 to Cory Cooper ("the '981 patent") incorporated by reference herein for all purposes, while in alternate embodiments the recess can be configured to receive alternative objects as desired.

Certain embodiments of the present invention, as shown in FIG. 1A-FIG. 1E for example, comprise an inflatable platform having a circular perimeter 1050. Alternate embodiments comprising inflatable platforms 1000 having alternate perimetral shapes are within the spirit and scope of the present invention. Inflatable platforms having perimetral forms which are regular polygons, equilateral polygons, and equiangular polygons are within the spirit and scope of the present invention. Furthermore, irregular shapes and irregular polygonal shapes are within the spirit and scope of the present invention.

Figure 2A:
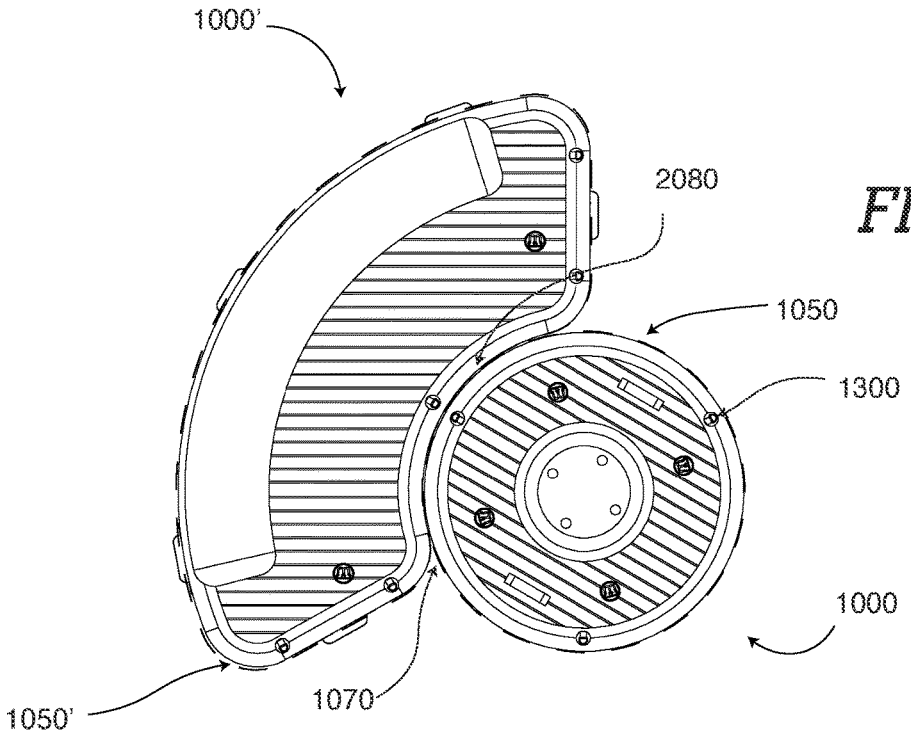

In certain embodiments, as shown in FIG. 2A for example, the interconnection of a first inflatable platform 1000 with a second inflatable platform 1000' results in continuous contact between a portion of the perimeter 1050 of the first inflatable platform and a portion of the perimeter 1050' of the second inflatable platform.

Figure 2B:
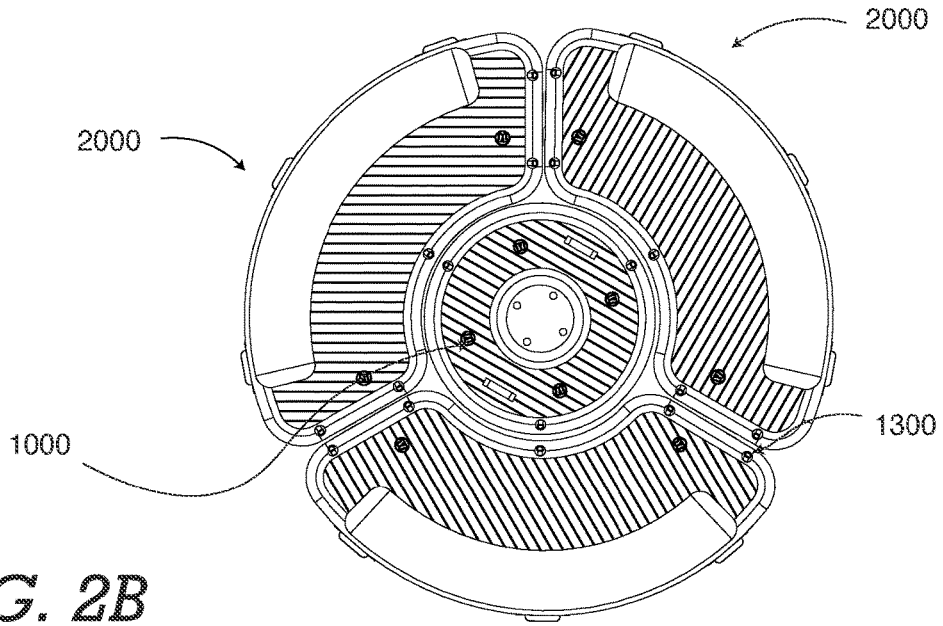
Figure 3A:
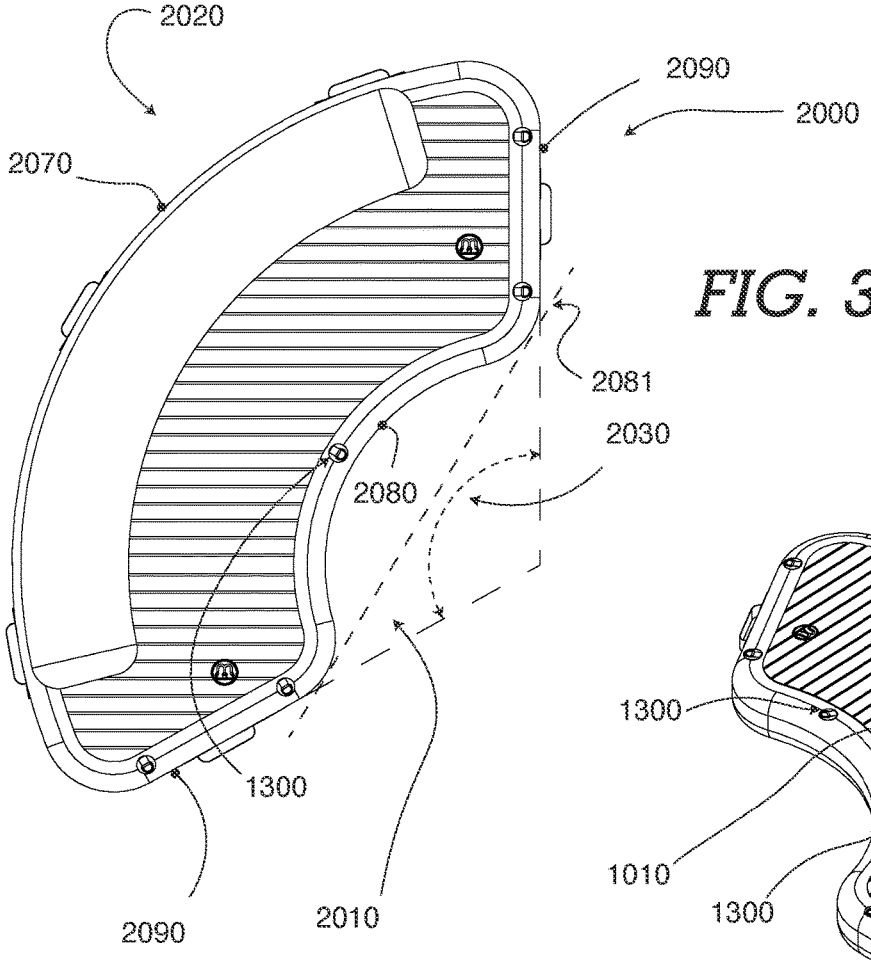
Figure 3C:
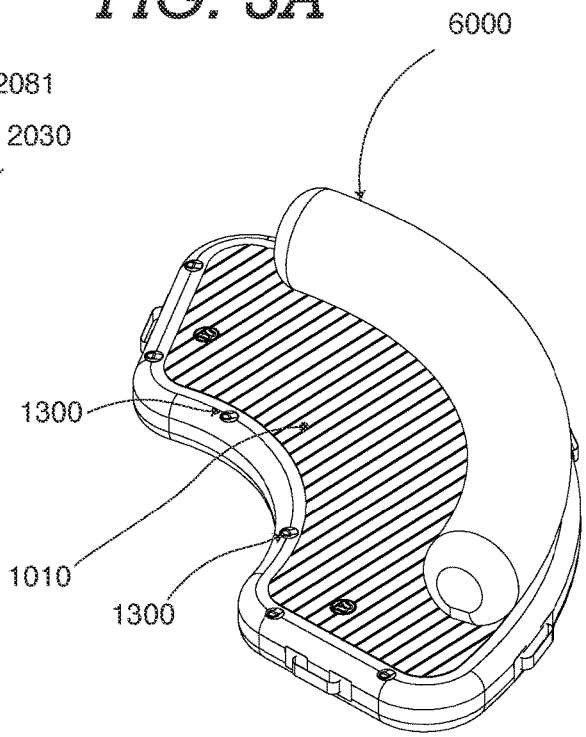
Figure 3B:
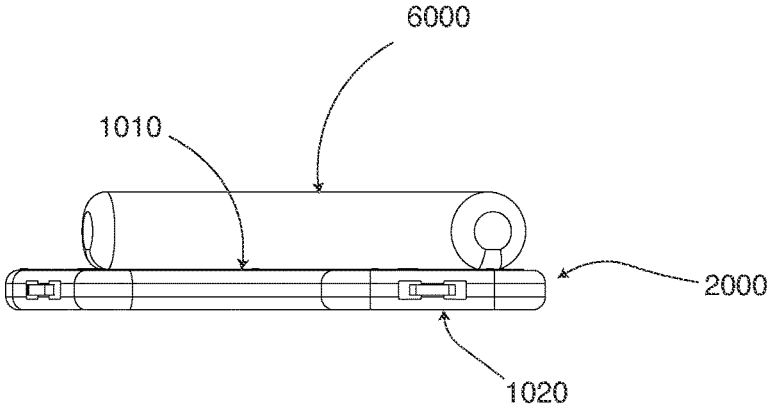

Certain embodiments of the present invention, as shown in FIG. 3A-FIG. 3B for example, comprise an arced shaped inflatable platform 2000 wherein a first side 2010 of the perimeter of the inflatable platform comprises an internal perimetral aspect 2080. Although a first side 2010 comprising a constant radius arc is shown, embodiments comprising an internal perimetral aspect 2080 having a polygonal or variable radius arc shape are within the spirit and scope of the present invention. In certain embodiments, as shown in FIG. 2A-FIG. 2B, a portion of the perimeter 1050 of a first inflatable platform 1000 is configured to be received by and interconnect with a second inflatable platform 1000' having an internal perimetral aspect 2080. The perimeter 1050 of the first inflatable platform comprises an external perimetral aspect 1070.

Certain embodiments of the present invention comprise an arced inflatable platform 2000 having an arced internal perimetral aspect 2080, an arced external perimetral aspect 2070, and linear aspects 2090 extending therebetween. In certain embodiments, as shown, the linear aspects 2090 are orthogonal to the internal perimetral aspect 2080 and the external perimetral aspect 2070. The arced internal perimetral aspect 2080 is configured to interconnect with a circular inflatable platform 1000 (as shown in FIG. 2A-FIG. 2B) resulting in continuous contact between the internal perimetral aspect 2080 of the arced inflatable platform and a portion of the perimeter 1050 of the circular inflatable platform. In certain embodiments the arced inflatable platform 2000 comprises an internal perimetral aspect 2080 having an arc-angle which is a mathematical factor of 360, wherein a plurality of arced inflatable platforms 2000 are configured to fully surround the circular inflatable platform 1000.

In certain embodiments, as shown in FIG. 2A-FIG. 3C for example, an arced inflatable platform 2000 comprises an internal perimetral aspect 2080 having an arc-angle 2030 of 120-degrees wherein the second inflatable platform 2000 is configured to interconnect with a first circular inflatable platform 1000, wherein three second inflatable platforms interconnected with the first circular inflatable platform 1000 will result in fully surrounding the circular inflatable platform.

Figure 4A:
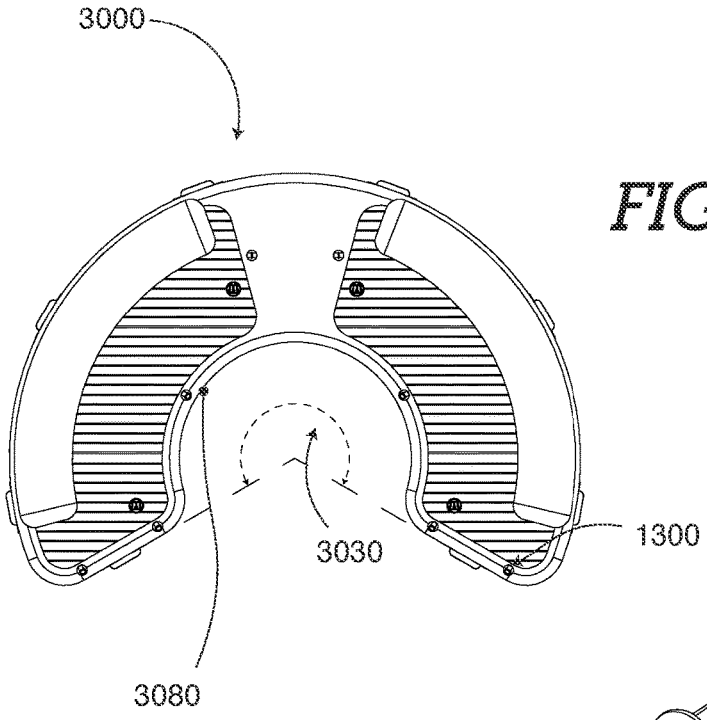
Figure 4C:
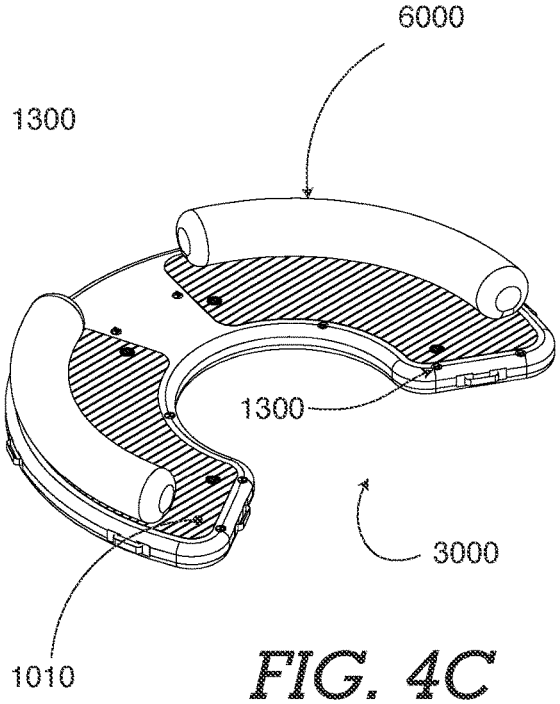
Figure 4B:
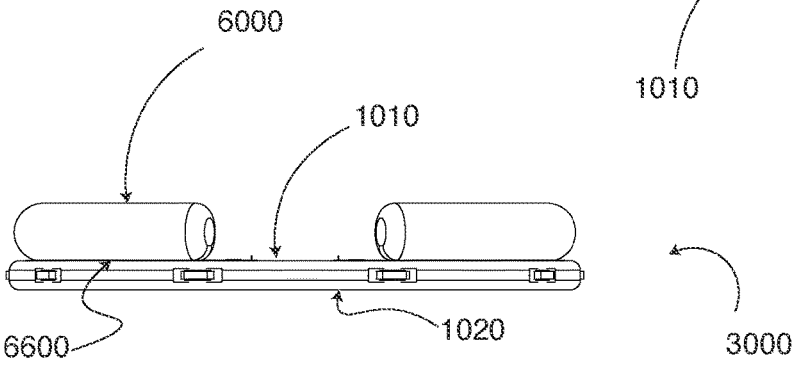

In certain embodiments, as shown in FIG. 4A-FIG. 4C for example, an arced inflatable platform 3000 comprises an internal perimetral aspect 3080 having an arc-angle of less than 360-degrees. In certain embodiments, an arced inflatable platform comprises an internal perimetral aspect having an arc-angle 3030 of 240-degrees. Accordingly, an arced inflatable platform 3000 having an internal perimetral aspect having an arc-angle of 240-degrees, and an arced inflatable platform 2000 (FIG. 3A-FIG. 3C) having an arc-angle 2030 of 120-degrees interconnected with a circular inflatable platform 1000 results in fully surrounding the circular inflatable platform 1000.

Figure 5A:
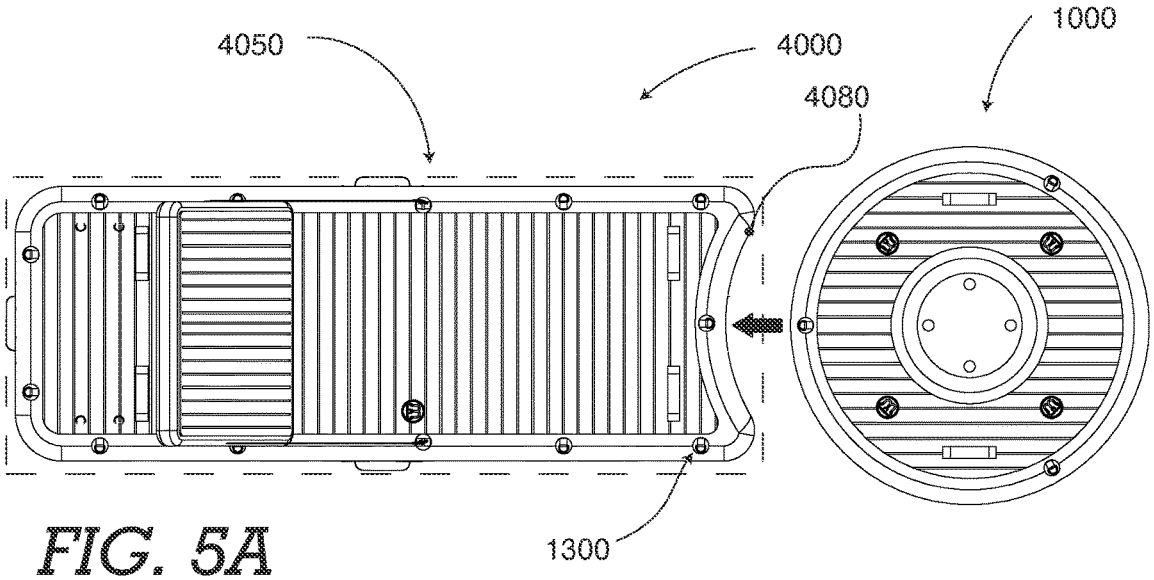
Figure 5C:
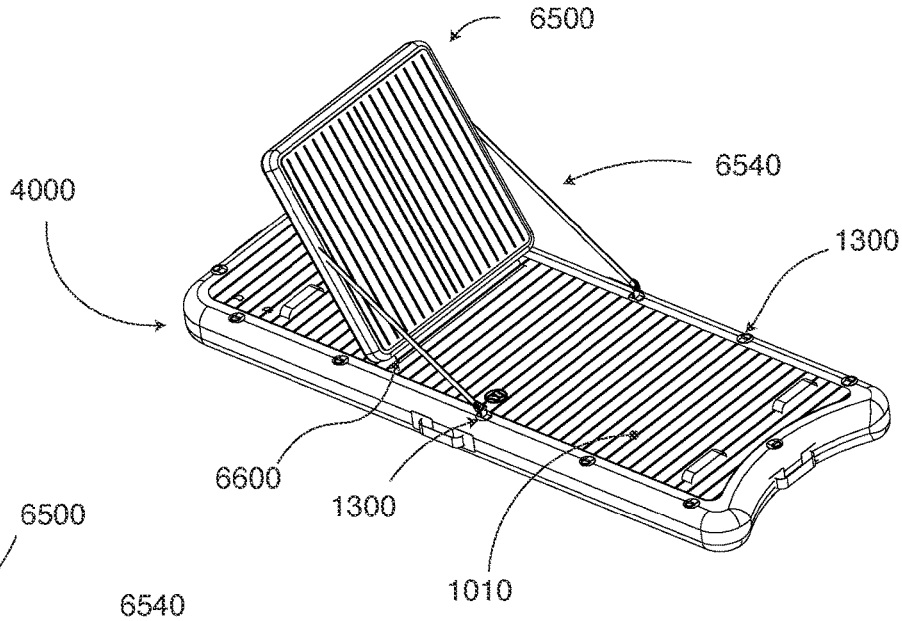
Figure 5B:
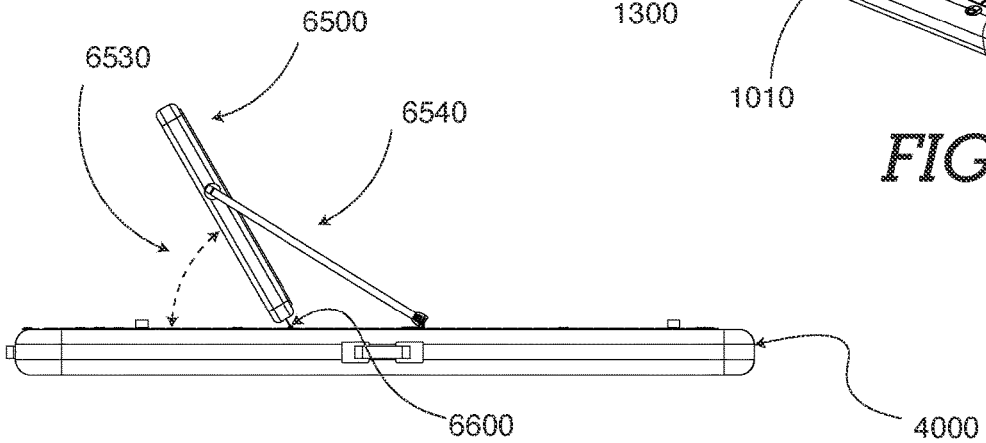

In certain embodiments, as shown in FIG. 5A-FIG. 5C, an inflatable platform 4000 comprises a rectangular shape 4050. In certain embodiments a rectangular inflatable platform comprises a side with an internal perimetral aspect 4080. For instance as shown, the side of certain embodiments comprises a concave form configured to interconnect with a an inflatable platform having an external perimetral aspect. For instance, the internal perimetral aspect 4080 as shown is configured to interconnect with a circular inflatable platform 1000 resulting in continuous contact between the rectangular inflatable platform 4000 and the circular inflatable platform 1000.

Figure 6A:
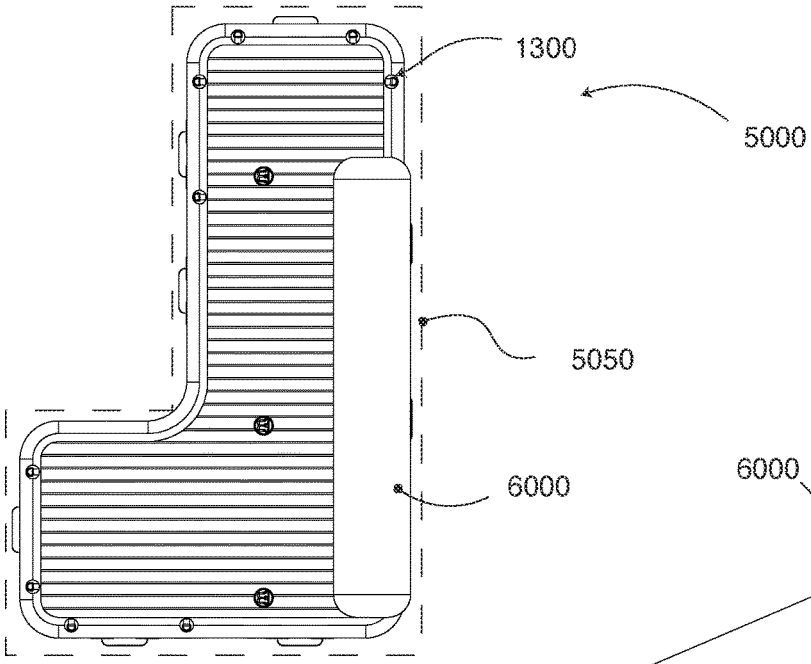
Figure 6C:
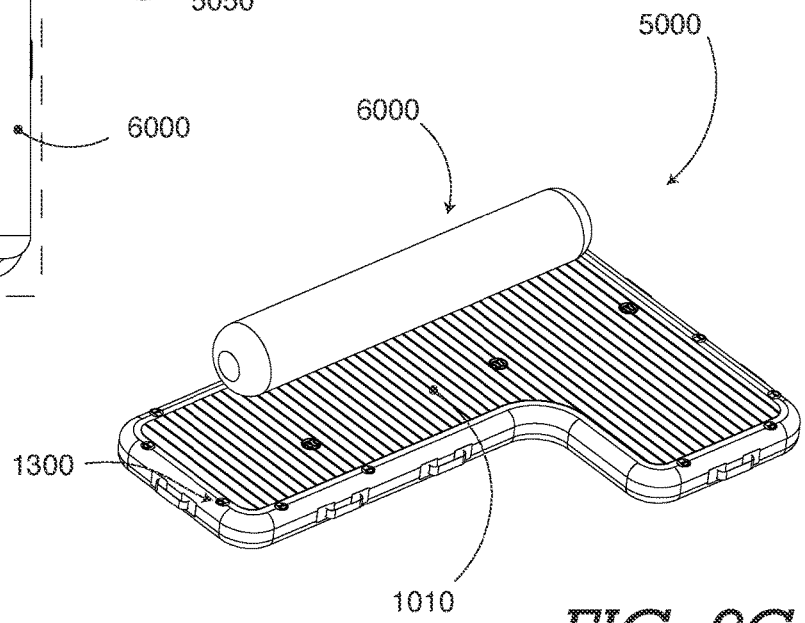
Figure 6B:
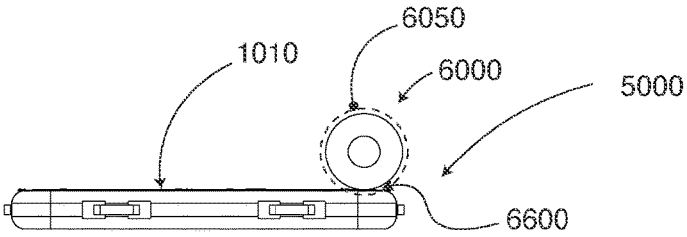
Figure 7A:
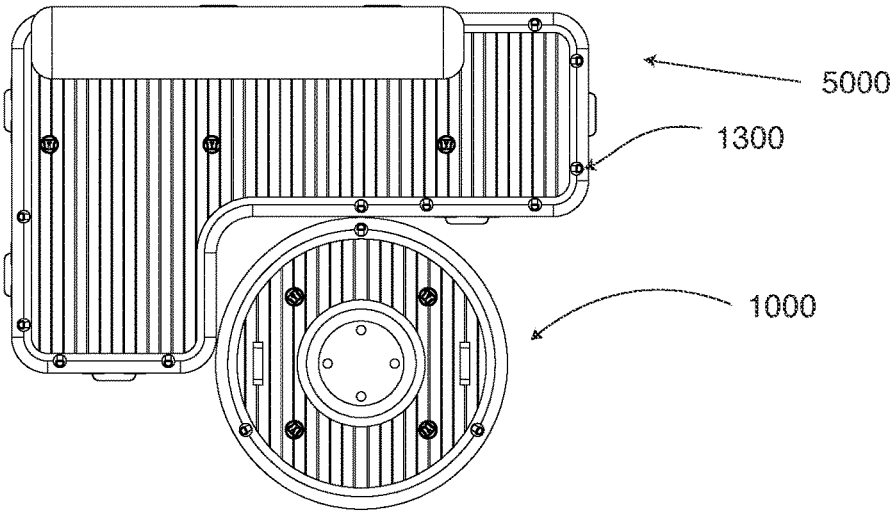
Figure 7B:
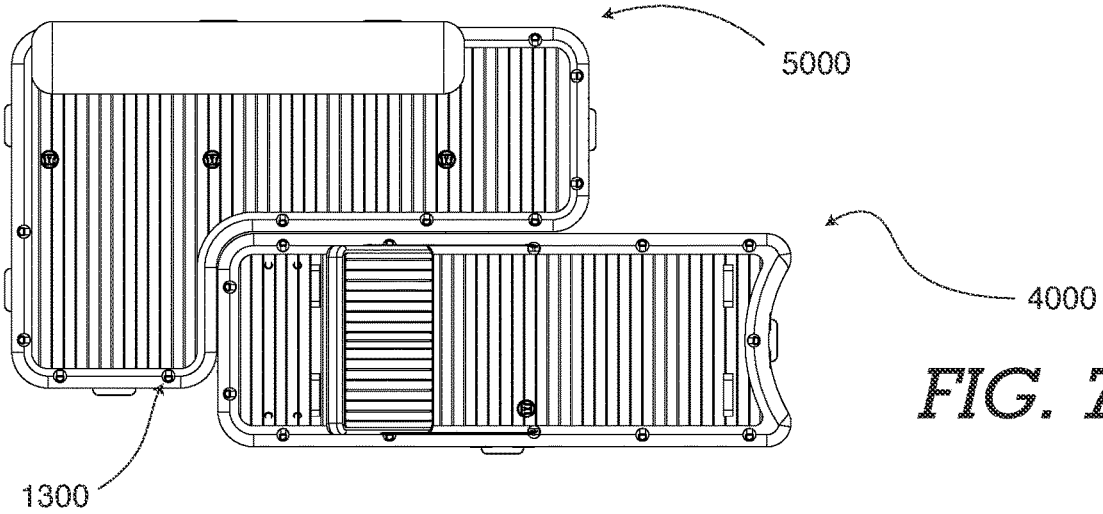
Figure 7C:
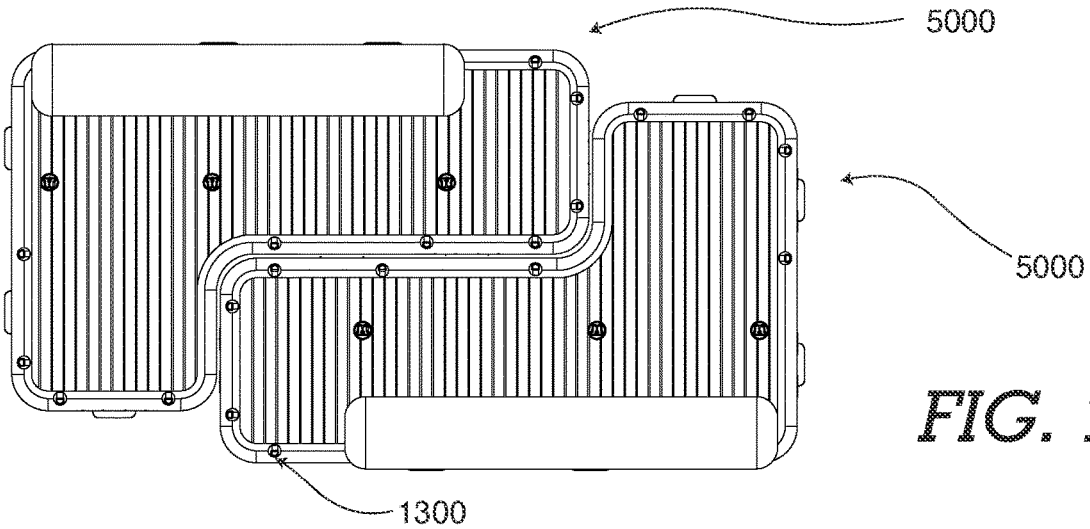

In certain embodiments of the present invention, shown in FIG. 6A-FIG. 6C for example, an inflatable platform 5000 comprises an L-shaped perimeter 5050. In certain embodiments such as shown in FIG. 7A, the interconnection of an L-shaped inflatable platform 5000 with a second inflatable platform, such as a circular inflatable platform 1000, results in two points of contact between the inflatable platforms. In alternate embodiments such as shown in FIG. 7B, an L-shaped inflatable platform 5000 is interconnected with a second inflatable platform, such as a rectangular inflatable platform 4000, resulting in the L-shaped inflatable platform 5000 having at least one side with continuous contact with the second inflatable platform. In certain embodiments such as shown in FIG. 7B, an L-shaped inflatable platform 5000 is interconnected with a rectangular shaped inflatable platform 4000 wherein the L-shaped inflatable platform 5000 has continuous contact with two sides of the rectangular shaped inflatable platform 4000. In further embodiments, such as shown in FIG. 7C, a first L-shaped inflatable platform 5000 is interconnected with a second L-shaped inflatable platform 5000 wherein the L-shaped inflatable platforms have 3 sides with continuous contact.

In certain embodiments, such as shown in FIG. 6A-FIG. 6C, an inflatable platform comprises an inflatable bolster 6000 having a circular cross-section 6050. The bolster 6000 is configured to interconnect with a top surface 1010 of the inflatable platform. In certain embodiments the bolster 6000 comprises a linear form, while alternative embodiments comprises an arced form such as shown in FIG. 3A-FIG. 4C.

In certain embodiments, as shown in FIG. 5A-FIG. 5C and FIG. 8A-FIG. 8C, an inflatable platform comprises a back-rest 6500 configured to interconnect with a top surface 1010 of an inflatable platform wherein the back-rest 6500 is configured to be hingedly affixed to the top surface of the inflatable platform, allowing the angle 6530 between the back-rest 6500 and the top surface 1010 of the inflatable platform to be adjusted between about 0-degrees and 180-degrees. In certain embodiments the backrest 6500 is fixed in the desired position using a first tether 6540 interconnected to a first side 6501 of the back-rest and a second tether 6540 interconnected with a second side 6502 of the back-rest wherein the tethers are configured to interconnect with interconnection points 1300 interconnected with the inflatable platform 4000. The tethers 6540 are configured to constrain the back-rest to a desired angle 6530.

Figure 8A:
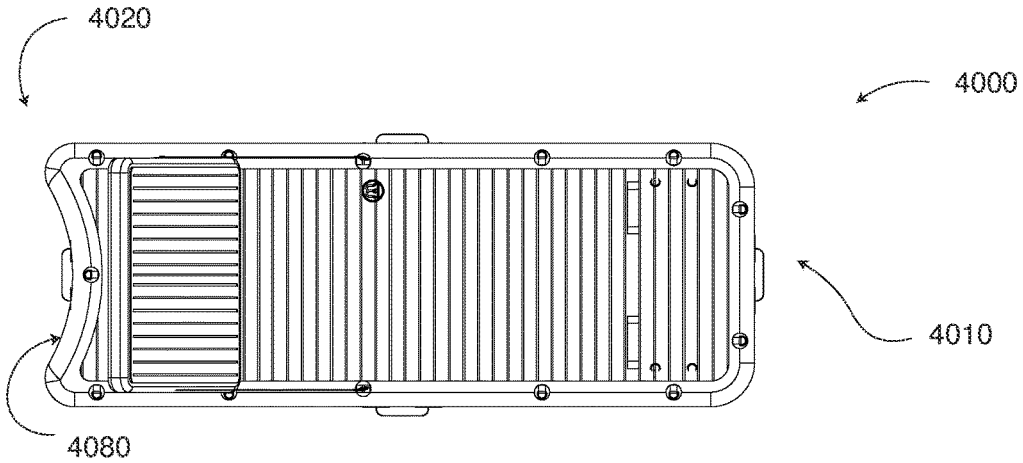
Figure 8B:
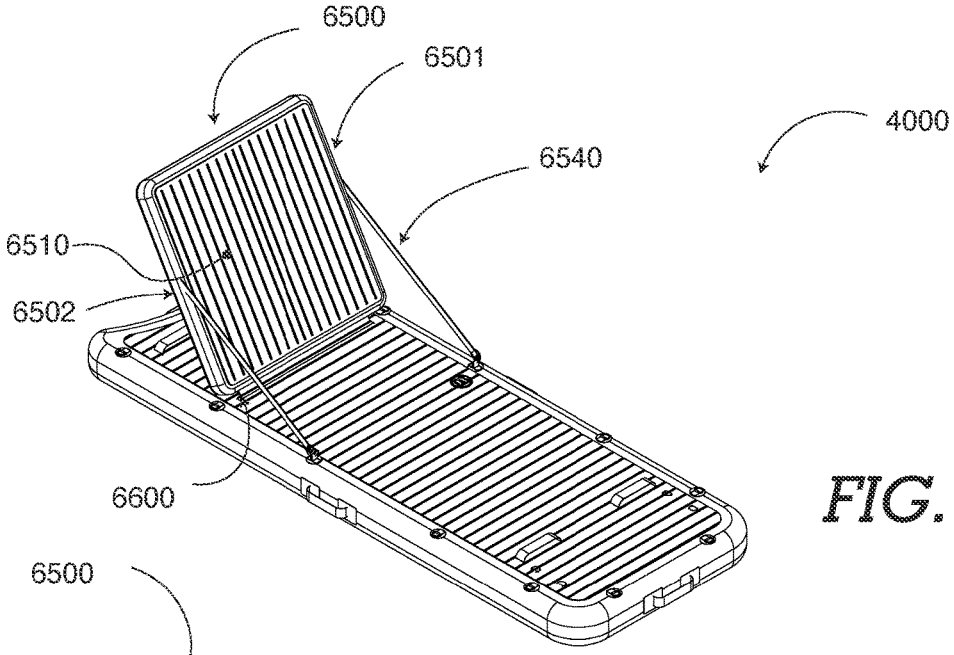

In certain embodiments, the inflatable platform as shown in FIG. 5A-5C comprises an internal perimetral aspect 4080 located at a forward aspect of inflatable platform 4000 and forward of the back-rest 6500. In certain embodiments, as shown in FIG. 8A-FIG. 8B for instance, an internal perimetral aspect 4080 is located at a rearward aspect of inflatable platform 4000 and rearward of the back-rest 6500. In certain embodiments the back rest 6500 is removably interconnected to the inflatable platform 4000 wherein the back-rest 6500 can be removed or reconfigured between a configuration wherein a front aspect 6510 of the back-rest faces a first end 4010 of the inflatable platform, and a configuration wherein the front aspect 6510 of the seat-back faces a second end 4020 of the inflatable platform.

Figure 8C:
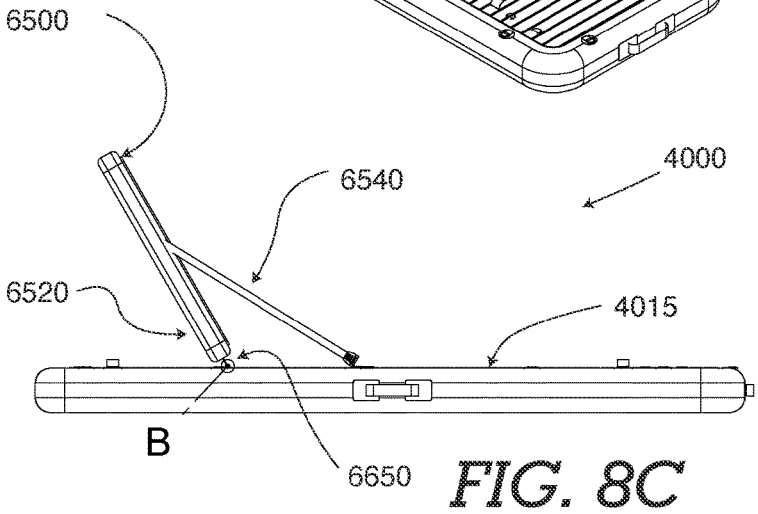
Figure 8D:
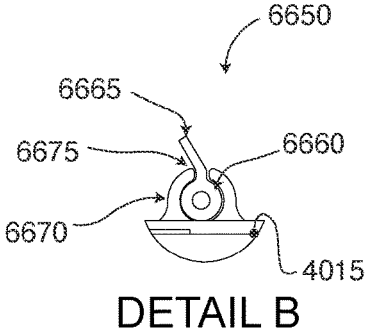

In certain embodiments, as shown in FIG. 8C-FIG. 8D for instance, a bottom aspect 6520 of the seat-back is interconnected with a top surface 4015 of the inflatable platform. In certain embodiments the back-rest comprises an interconnection point 6600 with the inflatable platform. In certain embodiments the interconnection point 6600 comprises a living hinge or other flexible connection with the inflatable platform, such as a polymeric sheet material. Polymeric sheet materials as discussed herein include, without limitation, PVC, urethane, and chlorosulfonated polyethylene synthetic rubber. In certain embodiments the interconnection point 6600 is elongated along the bottom aspect of the seat-back.

In certain embodiments the interconnection point 6600 comprises a hinged interconnection 6650 between the back-rest and the inflatable platform comprising a male feature 6660 and a female feature 6670, wherein the male feature 6660 is configured to be slidably received within the female feature 6670. In certain embodiments male feature 6660 and a female feature 6670 are elongated.

In certain embodiments, female feature 6670 comprises a hollow form and a longitudinal slot 6675 wherethrough a tensile member 6665 such as a flexible sheet material can be disposed, wherein the tensile member 6665 interconnects between the male feature 6660 of the hinged connection and the bottom aspect 6520 of the back-rest. Embodiments shown herein demonstrate the female feature 6670 interconnected with the top surface 4015 of the inflatable platform and the male feature 6660 interconnected with the back-rest 6500. However, embodiments wherein the back-rest 6500 is interconnected with the female feature 6670 and wherein the male feature 6660 is interconnected with the top surface

4015 of the inflatable platform are within the spirit and scope of the present invention. As shown, in certain embodiments the male feature 6660 comprises a round cross-section and the female feature comprises a round cross-section configured to receive the male feature. However, the male feature 6660 and the female feature 6670 are not limited to round cross-sectional profiles and alternate cross-sectional profiles, such as square, rectangular, or triangular, are within the spirit and scope of the present invention.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed:

1. An inflatable apparatus comprising:

a first inflatable platform comprising a top surface;

an inflatable back-rest comprising a bottom aspect, the bottom aspect comprising a hinged connection to the top surface of the inflatable platform, wherein the hinged connection comprises a female portion comprising a longitudinal hollow form and a longitudinal slot; and a male portion interconnected to a tensile member, wherein the male portion is configured to be slidably received by the hollow form of the female portion, and wherein the tensile member is configured to be received by the slot of the female portion;

a first tether interconnected between the first inflatable platform and a first side of the back-rest; and a second tether interconnected between the first inflatable platform and a second side of the back-rest, wherein the first and second tethers are configured to maintain the back-rest at a desired angle from the first inflatable platform.

2. The inflatable apparatus of claim 1, wherein the hinged connection further comprises a polymeric sheet material.

3. The inflatable apparatus of claim 1, wherein the tensile member comprises a flexible material which interconnects the male feature to the bottom aspect of the back-rest, and wherein the female feature is interconnected with the top surface of the first inflatable platform.

4. The inflatable apparatus of claim 3, wherein the male feature comprises a round cross-sectional profile, and wherein the female feature comprises a round cross-sectional profile configured to receive the male feature therein.

5. The inflatable apparatus of claim 1, wherein the tensile member comprises a flexible material which interconnects the male feature to the top surface of the first inflatable platform, and wherein the female feature is interconnected to the bottom aspect of the back-rest.

6. The inflatable apparatus of claim 5, wherein the male feature comprises a round cross-sectional profile, and wherein the female feature comprises a round cross-sectional profile configured to receive the male feature therein.

7. The inflatable apparatus of claim 1, wherein the back-rest is removably interconnected with the first inflatable platform.

8. The inflatable apparatus of claim 1, wherein the first inflatable platform comprises a first external perimetral aspect adapted to nest with an internal perimetral aspect of a second inflatable platform.

9. The inflatable apparatus of claim 8, wherein the first external perimetral aspect is located at a forward aspect of the inflatable platform.

10. The inflatable apparatus of claim 8, wherein the first external perimetral aspect is located at a rearward aspect of the inflatable platform.

11. The inflatable apparatus of claim 8, wherein the first external perimetral aspect comprises an interconnection point adapted to interconnect with an interconnection point of the internal perimetral aspect of the second inflatable platform.

12. The inflatable apparatus of claim 1, wherein the first inflatable platform comprises a first internal perimetral aspect adapted to nest with an external perimetral aspect of a second inflatable platform.

13. The inflatable apparatus of claim 12, wherein the first internal perimetral aspect is located at a forward aspect of the inflatable platform.

14. The inflatable apparatus of claim 12, wherein the first internal perimetral aspect is located at a rearward aspect of the inflatable platform.

15. The inflatable apparatus of claim 12, wherein the first internal perimetral aspect comprises an interconnection point adapted to interconnect with an interconnection point of the external perimetral aspect of the second inflatable platform.

16. The inflatable apparatus of claim 1, further comprising a magnetic connection apparatus interconnected to a top surface of the first inflatable platform.

17. An inflatable apparatus comprising:

a first inflatable platform comprising a top surface, wherein the first inflatable platform comprises a first internal perimetral aspect adapted to nest with an external perimetral aspect of a second inflatable platform;

an inflatable back-rest comprising a bottom aspect, the bottom aspect comprising a hinged connection to the top surface of the inflatable platform;

a first tether interconnected between the first inflatable platform and a first side of the back-rest; and a second tether interconnected between the first inflatable platform and a second side of the back-rest, wherein the first and second tethers are configured to maintain the back-rest at a desired angle from the first inflatable platform.

18. The inflatable apparatus of claim 17, wherein the hinged connection further comprises a female portion comprising a longitudinal hollow form and a longitudinal slot; and a male portion interconnected to a tensile member, wherein the male portion is configured to be slidably received by the hollow form of the female portion, and wherein the tensile member is configured to be received by the slot of the female portion.

19. The inflatable apparatus of claim 18, wherein the tensile member comprises a flexible material which interconnects the male feature to the bottom aspect of the back-rest, and wherein the female feature is interconnected with the top surface of the first inflatable platform.

20. The inflatable apparatus of claim 19, wherein the male feature comprises a round cross-sectional profile, and wherein the female feature comprises a round cross-sectional profile configured to receive the male feature therein.

21. The inflatable apparatus of claim 18, wherein the tensile member comprises a flexible material which interconnects the male feature to the top surface of the first inflatable platform, and wherein the female feature is interconnected to the bottom aspect of the back-rest.

22. The inflatable apparatus of claim 21, wherein the male feature comprises a round cross-sectional profile, and wherein the female feature comprises a round cross-sectional profile configured to receive the male feature therein.

23. The inflatable apparatus of claim 18, wherein the back-rest is removably interconnected with the first inflatable platform.

24. The inflatable apparatus of claim 17, wherein the first internal perimetral aspect is located at a forward aspect of the inflatable platform.

25. The inflatable apparatus of claim 17, wherein the first internal perimetral aspect is located at a rearward aspect of the inflatable platform.

26. The inflatable apparatus of claim 17, wherein the first internal perimetral aspect comprises an interconnection point adapted to interconnect with an interconnection point of the external perimetral aspect of the second inflatable platform.

27. The inflatable apparatus of claim 17, further comprising a magnetic connection apparatus interconnected to a top surface of the first inflatable platform.

* * * * *